United States Patent [19]

Odabashian et al.

[11] Patent Number: 4,635,295

[45] Date of Patent: Jan. 6, 1987

[54] TAPED BAG WITH EXTENDED SIDE SEALS

[75] Inventors: Robert A. Odabashian, Greer; Benjamin G. Wofford, Spartanburg, both of S.C.

[73] Assignee: W. R. Grace & Co., Cryovac Div., Duncan, S.C.

[21] Appl. No.: 651,722

[22] Filed: Sep. 18, 1984

[51] Int. Cl.[4] ..... B65D 30/00; B65D 33/00

[52] U.S. Cl. ..... 383/127; 383/37

[58] Field of Search ..... 383/37, 9, 127; 206/554; 229/69

[56] References Cited

U.S. PATENT DOCUMENTS

| | | | |
|---|---|---|---|
| 3,352,411 | 11/1967 | Scharzkopf . | |
| 3,372,857 | 3/1968 | Brayla . | |
| 3,587,843 | 6/1971 | Wing | 229/69 |
| 3,698,547 | 10/1972 | Roberts et al. | 229/69 |
| 3,763,627 | 10/1973 | Kupcikevicius . | |
| 3,770,134 | 11/1973 | Kupcikevicius . | |
| 3,783,580 | 1/1974 | Raudys . | |
| 3,804,322 | 4/1974 | Ericson . | |
| 4,076,122 | 2/1978 | Hall | 206/554 |
| 4,085,822 | 4/1978 | Osborn . | |
| 4,165,832 | 8/1979 | Kuklies . | |

FOREIGN PATENT DOCUMENTS 1481439 7/1977 United Kingdom .

*Primary Examiner*—Stephen P. Garbe

*Attorney, Agent, or Firm*—John J. Toney; William D. Lee, Jr.; Jennifer L. Skord

[57] ABSTRACT

The invention is directed to an improvement in flexible side-sealed taped bags having an extended lip rear panel. The external surface of the rear panel is releasably secured, at least at one point, to at least one tape (preferably two tapes) whereby a plurality of the bags may be advantageously presented in imbricated form. The improvement includes extension of the side seals of the front bag panel to the rear bag panel. The length of the extended side seals being such that their termination points are extended beyond the bag mouth so that the forces imposed on the bag mouth during loading of a product into the bag, while the bag is secured to the tape(s), act on the side seals below the side seal termination points. During product loading, the bag preferentially releases or separates from the tape(s) rather than tearing or delaminating at the side seal termination points. Preferably, the side seal termination points are at or above the point(s) at which the tape(s) is secured to the external surface of the rear panel of the bag.

5 Claims, 3 Drawing Figures

TAPED BAG WITH EXTENDED SIDE SEALS

BACKGROUND OF THE INVENTION

This invention relates generally to plastic packaging bags which are releasably secured to one or more tapes in imbricated form. Specifically, the invention relates to side sealed taped bags having an extended lip rear panel.

Side sealed bags are conventionally made in series from layflat tubular film by slitting one edge of the collapsed layflat tubing and transversely heat sealing the tubing at regular intervals with pairs of juxtaposed heat seals while imparting a line of weakness between the pair of heat seals. The slit edge of the tubing forms the bag mouth while the transverse seals form the bag sides. In other words the pair of heat seals will form the right side of one bag and the left side of an adjacent bag. The line of weakness between the heat seals allows separation of the bags from each other. When making a series of extended lip bags, a longitudinal strip along one face of the layflat tubing is usually removed adjacent the tubing edge which is to be the mouth end of the bags. Such bags thus have a front panel that is shorter than their rear panel so that the bag mouth is at the upper edge of the shortened front bag panel. The bags may be secured to one or more tapes by adhereing the tape(s) to the external surface of the rear panel of the bags at one or more points per bag. The thus taped bags may be taped in imbricated form. Product loading utilizing taped bags typically includes the steps of providing a roll of taped bags at a product loading station and thereafter directing an air jet at the mouth end of the uppermost bag to inflate the bag. At this point a product is inserted into the inflated bag with sufficient force to release or tear the bag from the tape which generally maintains bag alignment. It is desired that tearing or releasing of the bags preferably occurs at the point(s) at which the bag is adhered to the tape(s). This sequence is repeated for a series of products until the roll of taped bags is exhausted.

A substantial problem encountered with side sealed taped bags involves side seal integrity during product loading. The termination points of the side seals at the mouth end of the bag are relatively weak so that, upon the thrusting of a product into an inflated taped bag, forces are imposed upon the bag mouth that tend to tear or delaminate the side seals at their relatively weak termination points before the bag is torn or released from the tape(s). It is noted that the foregoing problem does not appear when using end sealed taped bags or end sealed wicketed bags. With regard to side sealed wicketed bags, one approach taken in attempting to overcome this problem has been to provide tear initiating slits at the tops of the wicket holes. However, this approach has the disadvantage that snagging problems are caused when bags of this design are utilized in bag separating apparatus wherein a perforated series of such bags is separated into individual bags. Also the tear initiation slits do not preclude the possibility of the side seals failing at their termination points. The present invention is directed to integral reinforcement of the side seal terminations in side sealed taped bags through extension of the side seals and thus the side seal termination points. As is disclosed in application Ser. No. 06/540,212 filed on Oct. 7, 1983, this reinforcement concept has been applied to wicketed bags. The subject matter of U.S. application Ser. No. 06/540,212 is hereby incorporated by reference.

Of general interest is the disclosure of U.S. Pat. No. 3,372,857 for "Side Seal Bag Construction with Stress Relief Notch" issued Mar. 12, 1968 to Brayla, directed to a side sealed extended lip wicketed bag having heat fused stress relief notches near the mouth end side seal terminations to prevent side seal delamination during loading of a product into the bag while wicketed.

Of additional general interest in the disclosure of U.S. Pat. No. 3,804,322 for "Plastic Bag Having Arcuate Closed End and Arcuate Lipped Open End" issued Apr. 16, 1974 to Ericson, directed to end sealed wicketed bags having an arcuate mouth end and an arcuate cut out in the front bag panel opposite wicketing holes in the rear bag panel. The configuration forms marginal ears at the mouth end of the end sealed bag for manual gathering of the bag mouth following product loading.

SUMMARY OF THE INVENTION

It is a primary object of the invention to provide a side sealed extended lip taped bag having extended side seals in the bag mouth area so that, during product loading, the bag preferentially tears or releases from the tape(s) at the point(s) of adhesion of the tape(s) to the external surface of the rear panel of the bag prior to tearing or delamination of the side seals. This object is generally accomplished by extension of the side seal termination points beyond the bag mouth, preferably beyond the point(s) of attachment of the tape(s) to the exterior surface of the rear panel of the bag.

Accordingly, the present invention provides a side sealed taped bag which, preferably, may be made from a flexible thermoplastic material. The bag comprises a rear panel having an extended lip with the exterior surface of the rear panel being releasably adhered, at one or more points, to at least one tape. In particular, the present invention comprises extension of the side seals which seal the front panel of the bag to the rear panel of the bag. In general, the length of the side seals should such that they extend to a point beyond the bag mouth preferably beyond the point(s) of attachment of the tape(s) to the exterior surface of the rear panel of the bag. This configuration will result in extension of the termination points of the side seals beyond the bag mouth so that, during loading of a product into a bag, while taped, the plane of action of loading forces intersects the side seals substantially below their termination points.

In a preferred mode wherein the taped bag is attached to a pair of symmetrically situated tapes, the plane of action of loading forces lies substantially in a plane defined by first and second points at the tops of the points of attachment of the tapes to the external surface of the rear panel of the bag, respectively, with the attachment points lying spaced apart by their layflat separation, and a third point at the center of the front panel of the bag mouth edge when the mouth is fully extended while the bag is constrained at said first and second points.

As stated above, preferably, the side seals extend past the bag mouth to at least about the tops of the attachment points of the tapes, and most preferably extend to the top of the extended lip.

The invention is also directed to a method for making a side sealed extended lip taped bag comprising the steps of: (1) forming a mouth end cutout in the front bag panel to partially expose the rear bag panel and form an extended lip and opposed marginal side seal extension areas in the front bag panel and (2) attaching one or more tapes to the exterior surface of the rear panel wherein the attachment points are selectively positioned such that, during loading of a product into said bag, while taped, the plane of action of loading forces intersects the side seals substantially below their extended termination points.

DESCRIPTION OF THE PREFERRED EMBODIMENTS

Figure 1:
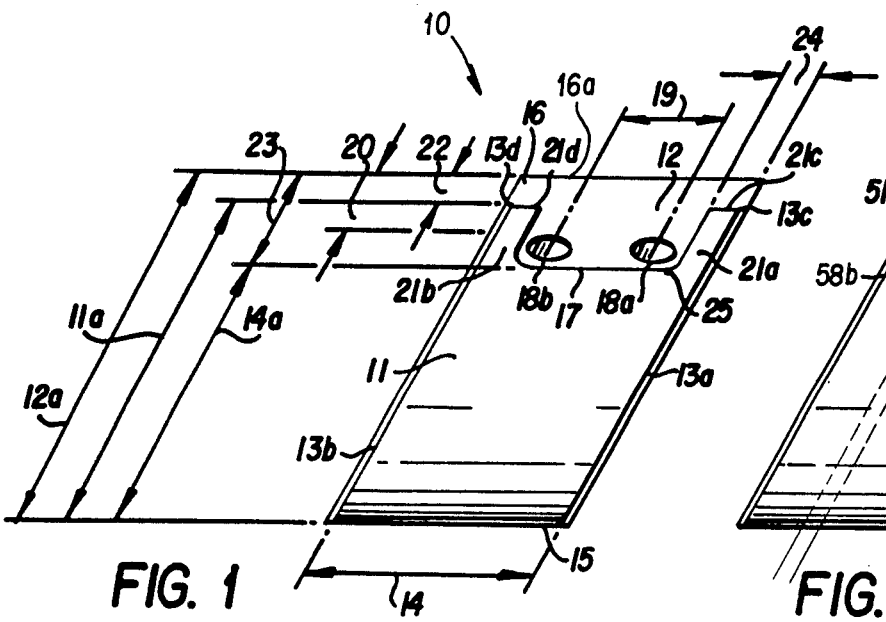
FIG. 1 demonstrates a side sealed extended lip taped bag according to the present invention which has been provided with extended side seals having termination points behond the mouth of the bag and which extend to about the top of the tape attachment points.

FIG. 1 illustrates a side sealed extended lip taped bag (tapes not illustrated) 10 in accordance with the present invention. Bag 10 comprises front panel 11 and rear panel 12. Front panel 11 and rear panel 12 are joined together near their edges or margins by side seals 13*a* and 13*b*. Side seals 13*a* and 13*b* are preferably heat seals. Side seals 13*a* and 13*b* are spaced apart by width 14 which defines the width of the product containing enclosure of bag 10. Bag bottom 15, optionally, is seamless as shown. This configuration may result when bag 10 is formed from a layflat tube. Rear panel 12 has a length 12*a* greater than the length 11*a* of front panel 11. Accordingly, extended lip 16 results. The bag mouth 17 is spaced below the edge 16*a* of the extended lip by a distance 23. The length 14*a* of the product containing envelope of bag 10 runs from bag mouth 17 to bag bottom 15. The exterior (obverse) surface of the extended lip 16 has a pair of tapes attached thereto. Tape attachment points 18*a* and 18*b* are symmetrically situated across the bag and are spaced apart, by a center-to-center distance 19. The tape attachment points may extend entirely to the edge 16*a* of extended lip 16. The bottom of attachment points 18 is preferably at or above bag mouth 17. However, the attachment points may be located such that the bottom of the attachment points is below the mouth by a small distance, e.g. up to about one-half of the length of the attachment points. The tops of the attachment points are spaced below the edge 16*a* of extended lip 16 by distance 20.

In accordance with the present invention the front panel of bag 10 is provided with two marginal portions 21*a* and 21*b* which marginally extend front panel 11 upward from mouth 17 toward the edge 16*a* of extended lip 16. The length of portions 21*a* and 21*b* (extension of the portions from the bag mouth 17 toward edge 16*a*) must be greater than a minimum critical extension length which may be calculated and will be further discussed below. A generally applicable rule is that portions 21*a*, 21*b* should extend to or above the top of the tap attachment points 18*a* and 18*b*. Accordingly distance 22, which represents the distance between the edge 16*a* of extended lip 16 and the edges 21*c* and 21*d* of portions 21*a* and 21*b* will preferably be about equal to or less than distance 20. Optionally, portions 21 may extend to edge 16*a* of the extended lip 16 (distance 22 would equal zero). The width of portions 21 is indicated at 24 and, in general, will be sufficient to permit side seals 13*a* and 13*b* to be formed, without difficulty. Preferably, width 24 is greater than the heat effected zone near seals 13. This configuration minimizes puckering and thereby improves the layflatness of the bag. Typically, width 24 will be at least about one-fourth ($\frac{1}{4}$) inch. The purpose of portions 21 is to allow extension the bag side seals 13*a* and 13*b* (e.g. the seals which seal front panel 11 to rear panel 12) beyond the bag mouth 17 by at least about a certain critical distance so that, during product loading of the bag in the taped configuration, the loading forces do not substantially act on the relatively weak termination points 13*c* and 13*d* of side seals 13. Therefore, during product loading, the bag preferentially releases or tears at the tape attachment points 18*a* and 18*b* rather than at heat seal termination points 13*c* and 13*d*. Preferably, mouth 17 is rounded (provided with rounds) 25 at the juncture between portions 21*a* and 21*b* and the bag mouth 17 for purposes of stress relief.

Figure 2:
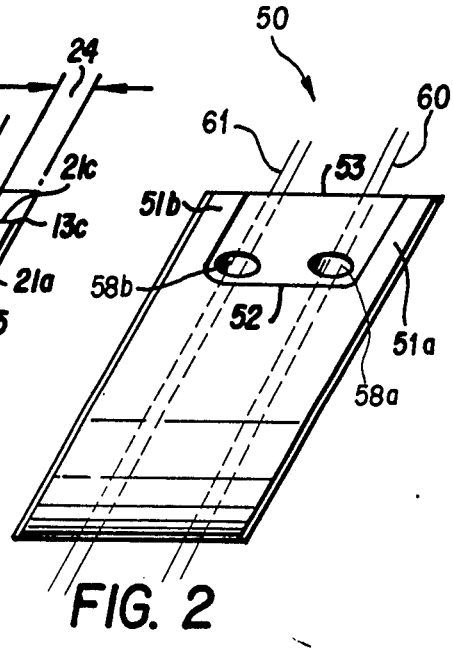
FIG. 2 demonstrates a modification of the embodiment of FIG. 1 wherein the side seals extend to the top of the extended lip of the rear bag panel.

FIG. 2 illustrates another embodiment of the present invention. Bag 50 is similar to bag 10 in all respects except that portions 51*a* and 51*b* extend fully from the bag mouth 52 to the edge of the extended lip 53, and that tape 60 and tape 61 are shown attached to attachment points 58*a* and 58*b*, respectively. This arrangement is preferred to promote convenience in bag making and may be simply formed by providing a conventional side sealed bag from layflat tubular film, as discussed above, and then making a mouth end cutout in the front bag panel with the cutout generally having a "U-shape." The desired number of tapes are then attached to the exterior surface of the rear panel of the bag. The tape attachment points of the tapes are selectively positioned in accordance with the invention. Preferably, a series of such bags, serially connected to each other by a perforated line of weakness, is made by: (1) providing a layflat tubular film of indefinite length; (2) slitting one edge of the collapsed layflat film; (3) forming U-shaped cutouts on one side of the layflat film at regular intervals along the length of the layflat film; (4) attaching selectively positioned tapes to the exterior surface of the rear panel of the bag, and (5) at regular intervals between said cutouts, forming pairs of juxtaposed transverse heat seals with a perforated line of weakness therebetween. The bag of FIG. 1 may be made in similar fashion except that the cutout would have a "flanged U-shaped". For convenience in heat sealing and heat seal bar construction, the heat effected area may extend to the edge 16*a* of the extended lip 16. That is, beyond portions 21.

Figure 3:
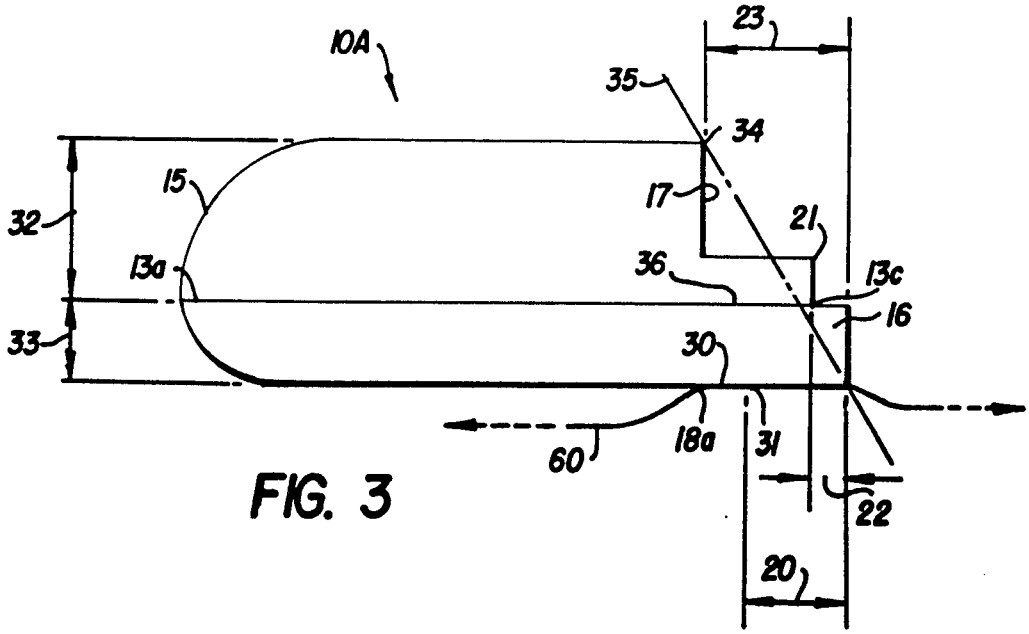
FIG. 3 schematically illustrates a loading force diagram for the bag of FIG. 1 in an inflated taped configuration.

FIG. 3 is a schematic side view representation of the bag 10 of FIG. 1 which is shown in a taped and inflated configuration 10A. FIG. 3 illustrates the product loading forces acting on the mouth of the bag and further illustrates the principles of the present invention. The bag is attached to tape 60 and tape 61 (not shown) at attachment points 18*a* and 18*b* (not shown) respectively. Inflation of the bag is accomplished by directing a jet of air into the bag mouth. This facilitates insertion of a product, such as whole poultry, into the bag at a loading station. The bag is constrained by the tapes 60 and 61 (not shown) with the approximate center of attachment point 18*a* being indicated at 30 (Tape 61 constrains the bag at attachment point 18*b*, not shown). The point of constraint of the bag being the top, indicated at 31, of attachment point 18*a*. Inflation of the bag while constrained at its attachment points expands the bag. Expansion of the bag above side seal 13 is indicated at 32 and is about equal to about one-half of distance 14, i.e. the spacing between the side seals. Expansion of the bag below the side seal 13 is indicated at 33 and is equal to about one half of distance 14 less the center-to-center attachment point distance 19. Point 34 indicates the center of the front panel of the bag mouth or the uppermost point of the bag mouth when inflated. Point 34 will be the primary point of bag/product contact upon the thrusting of a product into the inflated and thus expanded bag. Accordingly, the product loading forces will act on the bag mouth substantially at point 34 and the reaction forces associated with such loading forces will be applied at points 31 (the points of constraint of the bag by the tape attachment points). Line 35 represents the line of action of the loading forces. This line of action intersects side seal 13*a* approximately at point 36. An equivalent point of intersection with regard to side seal 13*b* (not shown) would occur at the opposite side of the bag. Line 35 is more properly characterized as a plane of action of loading forces. Depending upon the dimensions selected, point 36 may occur a small distance below the top 31 of the attachment point 18*a*. (The plane of action being defined by the two points 31, one for each attachment point, and point 34). A principle of the present invention is to direct the loading forces acting on the bag side seals to a point away from the relatively weak termination points 13*c*, 13*d* of side seals 13. If the plane of action were to pass through points 13*c* and 13*d* or to the right (above) of points 13*c* and 13*d* the side seals of the bag would, in all likelihood, tear, peel or delaminate during product loading. If the plane of action were to pass to the left of (below) points 13*c* and 13*d* the side seals of the bag, in all likelihood, would not tear, peel or delaminate during product loading.

Those of skill in the art will note that, in the general case, the plane of action of the product loading forces and its intersection with the side seals is readily determined by visual observation. Such determination may be carried out by first arranging a test bag in a layflat condition on a substantially flat surface while constraining the bag at the tops of its attachment points. At this point force is applied the bag mouth at about the center of the mouth edge thereby fully extending the bag mouth. In this extended and slightly stretched configuration, lines of tautness are clearly visible and the distribution of their relative degree of tautness is relatively easily discerned upon touching them. Therefore, the location of the intersection of such lines of tautness with the side seals is readily ascertainable. The plane of action of loading forces is considered to be about coextensive with the line of maximum tautness. Furthermore, the plane of action is considered to be substantially removed from (below) the side seal termination points when the tautness or stress distribution about this plane is about zero at the termination points.

Generally speaking, portions 21 should extend from the bag mouth to at least about the top of the attachment points 31. As can be seen from FIG. 3, when this condition is met the plane of action of loading forces will pass below termination point 13*c*, i.e. the point of termination of the side seal 13*a* at the top of the extensions. (Of course, the same statement is true with regard to termination point 13*d* and side seal 13*b*—not shown in FIG. 3) However, as can be seen from the diagram, the minimum critical extension length will be somewhat less than the tops of the attachment points.

As a first approximation, the minimum critical length of portions 21*a* and 21*b* (i.e. the distance from the bag mouth 17 to edges 21*c* and 21*d* of portions 21*a* and 21*b*) may be determined from the following equation, as determined from geometrical and elastic constraints:

$$A > B - \left[ (B-1)\left[\frac{(c-a)}{(2c-a)}\right] - 1.7903\left[\frac{O_T(t)}{(\epsilon-1)(X)(E)(b)(h^3)}\right]^{-\frac{1}{4}}\right]$$

where,

A = the length (in inches) of portions 21;

a = the center-to-center distance (in inches) between the two tape attachment points 18*a* and 18*b* [distance 19 in FIG. 1];

b = the width (in inches) of the side seals 13*a* and 13*b*;

c = the bag width spacing (in inches) between side-seals 13*a* and 13*b* [distance 14 in FIG. 1];

B = the bag mouth 17 spacing (in inches) from the edge 16*a* of the extended lip 16 [distance 23 In FIG. 1];

h = the mean thickness (in inches) of the side seals 13*a* and 13*b*;

E = the modulus of elasticity (in pounds per square inch) of the film material used to form the bag;

K = the film spring constant (in pounds per inch);

$O_T$ = the tensile strength (in pounds per square inch) of the film material;

X = the original length of sample (in inches);

$\epsilon$ = elongation (in inches per inch of material) and t = the mean average thickness (in inches) of the plastic film.

Although the present invention has been described in conjunction with several preferred embodiments, it is to be understood that modifications and variations may be utilized without departing from the principles and scope of the invention as defined by the following claims:

What is claimed is:

1. A flexible thermoplastic side-seal bag having a mouth and sides, said bag comprising:

a front panel defining the mouth of the bag, said front panel comprising two marginal portions extending a length A beyond said mouth;

a rear panel comprising a lip portion extending a length B beyond said mouth, said rear panel having at least one tape releasably attached to an exterior surface thereof;

side seals joining said front panel to said rear panel, said seals defining the sides of the bag, wherein length A is less than or equal to length B and length A and said side seals have termination points extending beyond the mouth of the bag and said marginal portions and said side seals at least past the point at which said tape is attached to said rear panel;

whereby, during loading of a product into said bag, while taped, the plane of action of loading forces intersects said side seals at a point substantially removed from said termination points.

2. The taped bag of claim 1 wherein length A is equal to length B.

3. The taped bag of claim 1 comprising a pair of attachment points symmetrically situated on the external surface of said rear panel with respect to a line defined by the midpoint of the lip edge of the rear panel and the midpoint of the bag bottom.

4. The taped bag of claim 3 wherein said marginal portions extend at least a length A beyond the bag mouth and wherein length A is determined by the following formula:

$$A > B - \left[ (B-1)\left[\frac{(c-a)}{(2c-a)}\right] - 1.7903\left[\frac{O_T(t)}{(\epsilon-1)(X)(E)(b)(h^3)}\right]^{-\frac{1}{4}}\right]$$

where,

A = the length (in inches) of the portions;

a = the center-to-center distance (in inches) between the two tape attachment points;

b = the width (in inches) of the side seals;

c = the distance (in inches) between the two side seals;

B = the distance (in inches) from the bag mouth to the edge of the extended lip;

h = the mean thickness (in inches) of the side seals;

E = the modulus of elasticity (in pounds per square inch) of the film material used to form the bag;

K = the film spring constant (in pounds per inch);

$O_T$ = the tensile strength (in pounds per square inch) of the film material;

X = the original sample length (in inches);

$\epsilon$ = elongation (in inches per inch of material); and t = the mean average thickness (in inches) of the plastic film.

5. The taped bag of claim 1 wherein said side seals have been formed by heat sealing and the width of said marginal portions is larger than the heat affected region around said side seals.

* * * * *

UNITED STATES PATENT AND TRADEMARK OFFICE

CERTIFICATE OF CORRECTION

PATENT NO. : 4,635,295

DATED : January 6, 1987

INVENTOR(S) : Robert A. Odabashian
Benjamin G. Wofford

It is certified that error appears in the above-identified patent and that said Letters Patent is hereby corrected as shown below:

In column 2, line 41 after "should" insert --be--.

In column 5, line 7 after "14 less" insert --about one half--.

Signed and Sealed this

Third Day of November, 1987

*Attest:*

DONALD J. QUIGG

*Attesting Officer*

*Commissioner of Patents and Trademarks*